US009103547B2

(12) United States Patent
Eroglu et al.

(10) Patent No.: US 9,103,547 B2
(45) **Date of Patent: *Aug. 11, 2015**

(54) METHOD FOR OPERATING A BURNER

(75) Inventors: Adnan Eroglu, Untersiggenthal (CH); Richard Carroni, Niederrohrdorf (CH); Stefano Bernero, Oberrohrdorf (CH)

(73) Assignee: ALSTOM TECHNOLOGY LTD, Baden (CH)

( * ) Notice: Subject to any disclaimer, the term of this patent is extended or adjusted under 35 U.S.C. 154(b) by 965 days.

This patent is subject to a terminal disclaimer.

(21) Appl. No.: 12/266,407

(22) Filed: Nov. 6, 2008

(65) Prior Publication Data

US 2009/0123882 A1 May 14, 2009

(30) Foreign Application Priority Data

Nov. 9, 2007 (CH) ..... 1738/07

(51) Int. Cl.

| | |
|---|---|
| ***F23D 14/02*** | (2006.01) |
| ***F23D 17/00*** | (2006.01) |
| ***F23C 7/00*** | (2006.01) |
| ***F23D 11/40*** | (2006.01) |

(Continued)

(52) U.S. Cl.

CPC ..... *F23D 17/002* (2013.01); *F23C 7/002* (2013.01); *F23D 11/402* (2013.01); *F23R 3/286* (2013.01); *F23C 2900/07002* (2013.01); *F23R 2900/00002* (2013.01)

(58) Field of Classification Search

CPC ..... F23C 7/02
USPC ..... 431/350, 353, 8, 9, 10; 60/722, 733, 60/737, 738

See application file for complete search history.

(56) References Cited

U.S. PATENT DOCUMENTS

| | | | | |
|---|---|---|---|---|
| 738,537 | A * | 9/1903 | Gwynn | 431/354 |
| 1,801,431 | A * | 4/1931 | Irish | 431/183 |

(Continued)

FOREIGN PATENT DOCUMENTS

| | | | | |
|---|---|---|---|---|
| DE | 4409918 | A1 * | 9/1995 | F23D 17/00 |
| DE | 19757189 | A1 | 6/1999 | |

(Continued)

OTHER PUBLICATIONS

Office Action (Decision of Refusal) issued on Jan. 6, 2014, by the Japanese Patent Office in corresponding Japanese Patent Application No. 2008-286623, and an English Translation of the Office Action. (7 pages).

*Primary Examiner* — Gregory Huson
*Assistant Examiner* — Nikhil Mashruwala
(74) *Attorney, Agent, or Firm* — Buchanan Ingersoll & Rooney PC

(57) ABSTRACT

A method and an apparatus are provided for the combustion of gaseous fuel containing hydrogen or consisting of hydrogen, with a burner which provides a swirl generator, into which liquid fuel is fed centrally along a burner axis, at the same time forming a conically shaped liquid fuel column which is surrounded by a rotating combustion air stream which flows tangentially into the swirl generator and into which, additionally, a gaseous and/or liquid fuel is injected so as to form a fuel/air swirl flow which is transferred downstream of the swirl generator, along a transitional portion, into a mixing zone following the transitional portion downstream and which is ignited and burnt in a combustion chamber following downstream, at the same time forming a backflow zone.

16 Claims, 8 Drawing Sheets

(51) Int. Cl.

| | |
|---|---|
| ***F23R 3/28*** | (2006.01) |
| *F23C 7/02* | (2006.01) |

(56) References Cited

U.S. PATENT DOCUMENTS

| | | | | | |
|---|---|---|---|---|---|
| 1,910,735 | A * | 5/1933 | Zikesch | 110/264 |
| 2,647,568 | A * | 8/1953 | Sloan | 431/183 |
| 3,973,395 | A * | 8/1976 | Markowski et al. | 60/733 |
| 4,095,929 | A * | 6/1978 | McCartney | 431/19 |
| 4,175,920 | A * | 11/1979 | Guerre et al. | 431/175 |
| 4,561,841 | A * | 12/1985 | Korenyi | 431/265 |
| 4,604,050 | A * | 8/1986 | Henriksson | 431/121 |
| 4,859,173 | A * | 8/1989 | Davis et al. | 431/175 |
| 4,932,861 | A | 6/1990 | Keller et al. | |
| 5,375,995 | A * | 12/1994 | Dobbeling et al. | 431/8 |
| 5,482,457 | A * | 1/1996 | Aigner et al. | 431/351 |
| 5,584,684 | A * | 12/1996 | Dobbeling et al. | 431/285 |
| 5,588,826 | A * | 12/1996 | Dobbeling et al. | 431/354 |
| 5,623,819 | A * | 4/1997 | Bowker et al. | 60/776 |
| 5,626,017 | A * | 5/1997 | Sattelmayer | 60/723 |
| 5,645,410 | A * | 7/1997 | Brostmeyer | 431/10 |
| 5,673,551 | A * | 10/1997 | Dobbeling | 60/776 |
| 5,735,687 | A | 4/1998 | Knopfel et al. | |
| 5,833,451 | A * | 11/1998 | McMillan | 431/350 |
| 5,895,211 | A * | 4/1999 | McMillan | 431/10 |
| 5,937,632 | A * | 8/1999 | Dobbeling et al. | 60/777 |
| 6,045,351 | A | 4/2000 | Dobbeling et al. | |
| 6,126,439 | A | 10/2000 | Knopfel et al. | |
| 6,152,726 | A * | 11/2000 | Ruck et al. | 431/284 |
| 6,331,109 | B1 * | 12/2001 | Paikert et al. | 431/350 |
| 6,558,154 | B2 * | 5/2003 | Eroglu et al. | 431/8 |
| 7,003,957 | B2 * | 2/2006 | Griffin et al. | 60/737 |
| 7,137,809 | B2 * | 11/2006 | Bueche et al. | 431/12 |
| 7,140,183 | B2 * | 11/2006 | Ruck et al. | 60/737 |
| 7,445,445 | B2 * | 11/2008 | Eroglu et al. | 431/350 |
| 7,871,262 | B2 * | 1/2011 | Carroni et al. | 431/9 |
| 8,033,821 | B2 * | 10/2011 | Eroglu | 431/9 |
| 8,057,224 | B2 * | 11/2011 | Knoepfel | 431/354 |
| 2001/0024774 | A1 | 9/2001 | Berenbrink | |
| 2006/0154192 | A1 * | 7/2006 | Flohr et al. | 431/353 |
| 2007/0099142 | A1 * | 5/2007 | Flohr et al. | 431/354 |
| 2007/0259296 | A1 | 11/2007 | Knoepfel | |

FOREIGN PATENT DOCUMENTS

| | | | | |
|---|---|---|---|---|
| DE | 10026122 | A1 * | 11/2001 | F23D 14/62 |
| DE | 102004011150 | A1 * | 9/2004 | F23R 3/16 |
| EP | 0321809 | A1 | 6/1989 | |
| EP | 625673 | A2 * | 11/1994 | F23C 7/00 |
| EP | 0780629 | A2 | 6/1997 | |
| EP | 0833105 | A | 4/1998 | |
| EP | 1070915 | A1 | 1/2001 | |
| GB | 2345958 | A * | 7/2000 | F23R 3/34 |
| JP | 06-241423 | A | 8/1994 | |
| JP | 09327641 | A * | 12/1997 | B05B 7/10 |
| JP | 2002-523721 | A | 7/2002 | |
| WO | 9317279 | A1 | 9/1993 | |
| WO | WO 03036167 | A1 * | 5/2003 | F23C 7/00 |
| WO | 2005121648 | A | 12/2005 | |
| WO | 2006058843 | A | 6/2006 | |
| WO | WO 2006058843 | A1 * | 6/2006 | F23C 7/00 |
| WO | 2006069861 | A | 7/2006 | |

* cited by examiner

METHOD FOR OPERATING A BURNER

FIELD OF INVENTION

The invention relates to a method for operating a burner. It also relates to a burner for carrying out this method.

BACKGROUND

In light of the virtually worldwide endeavour to reduce the emission of greenhouse gases into the atmosphere, not least as laid down in what is known as the Kyoto protocol, the emission of greenhouse gases which is to be expected in 2010 is to be reduced to the same level as in 1990. The implementation of this plan requires great effort, particularly to reduce the contribution made by $CO_2$ releases caused by mankind. About one third of the $CO_2$ released into the atmosphere by mankind is attributable to energy generation in which mostly fossil fuels are burnt in power plants in order to generate electricity. Particularly due to the use of modern technologies and because of additional political framework conditions, a considerable potential for savings to avoid a further increasing emission of $CO_2$ can be seen to be achieved in the energy-generating sector.

One possibility, known per se and technically manageable, for reducing the $CO_2$ emission in combustion power stations is to extract carbon from the fuels to be burnt, which is implemented even before these are introduced into the combustion chamber. This presupposes corresponding fuel pretreatments involving, for example, the partial oxidation of the fuel with oxygen and/or a pretreatment of the fuel with steam. Fuels pretreated in this way mostly have a high fraction of $H_2$ and CO and, depending on the mixture ratios, have calorific values which, as a rule, lie below those of natural gas. Depending on their calorific value, gases produced synthetically in this way are designated as Mbtu or Lbtu gases which are not readily suitable for use in conventional burners designed for the combustion of natural gases, such as may be gathered, for example, from EP 0 321 809 B1, EP 0 780 629 A2, WO 93/17279 and EP 1 070 915 A1. All the above publications, which are incorporated by reference as if fully set forth, describe burners of the fuel premixing type in which in each case a swirl flow consisting of combustion air and of admixed fuel is generated, which widens conically in the flow direction and which in the flow direction, after emerging from the burner, becomes unstable due to the increasing swirl, as far as possible after a homogeneous air/fuel mixture is obtained, and changes to an annular swirl flow with backflow in the core.

Depending on the burner concept and as a function of the burner power, liquid and/or gaseous fuel is introduced to the swirl flow forming inside the premix burner, in order to produce as homogeneous a fuel/air mixture as possible. As mentioned above, however, it is appropriate, for the purposes of a reduced pollutant, in particular CO2, emission, to employ synthetically treated gaseous fuels alternatively to or in combination with the combustion of conventional types of fuel, and therefore special requirements arise with regard to the structural design of conventional premix burner systems. Thus, synthesis gases, in order to be fed into burner systems, require a multiple fuel volume flow, as compared with comparable burners operated with natural gas, thus resulting in markedly different flow impulse behavior. On account of the high fraction of hydrogen in the synthesis gas and the associated low ignition temperature and high flame velocity of the hydrogen, there is a high tendency of the fuel to react which leads to an increased risk of flashback. In order to avoid this, it is appropriate as far as possible to reduce the average staying time of ignitable fuel/air mixture within the burner.

A method and a burner for the combustion of gaseous or liquid fuel and of fuel containing hydrogen or consisting of hydrogen, synthesis gas in brief, have become known, as described in WO 2006/058843 A1. In this case, a premix burner, which has also become known as a double cone burner, with a downstream mixing zone according to EP 0 780 629 A2 is used, which is illustrated diagrammatically in a longitudinal sectional illustration in FIGS. 2*a* and *b*. The premix burner arrangement provides a swirl generator 1 which widens conically in the burner longitudinal axis and which is delimited by swirl producing shells 2. Means for the infeed of fuel are provided axially and coaxially around the burner axis A of the swirl generator 1. Thus, liquid fuel $B_f$ passes into the swirl space through an injection nozzle 3 positioned along the burner axis A at the location of the smallest inside diameter of the swirl generator 1. Along tangential air inlet slots 4, via which combustion air L enters the swirl space in a tangential flow direction, gaseous fuel $B_g$, preferably natural gas, is admixed to the combustion air L. In addition, injection devices 5 are provided (see FIG. 2*b*) which serve for the further infeed of synthesis gas $B_{H2}$.

The fuel/air mixture forming within the swirl generator 1 passes as a swirl flow through a transitional portion 6, which provides flow means 7 stabilizing the swirl flow, into a mixing pipe 8 in which a fully homogeneous intermixing of the fuel/air mixture forming takes place, before the ignitable fuel/air mixture is ignited within a combustion chamber B following the mixing pipe 8 downstream. On account of a discontinuous enlargement of the flow cross section during the transition from the mixing pipe 8 into the combustion chamber B, the swirl flow of the intermixed fuel/air mixture breaks open, at the same time producing a recirculation flow RB in the form of a backflow bubble in which a spatially stable flame front is established.

The flow profile forming along the burner is illustrated in FIG. 2*a* and is distinguished by a marked velocity maximum longitudinally with respect to the burner axis A, the amount of which lies mostly three to four times above those flow velocities which can be formed near the burner wall. On account of this drastic velocity difference between the burner axis and burner wall, local flow vortices are established near the burner wall, which lead to local fuel concentrations and, particularly in the case of an additional infeed of synthesis gas, contribute, because of the high ignition potential caused by the hydrogen fraction, to an increased risk of flame flashback which it is appropriate to avoid. In order to reduce the risk of flame flashback, therefore, along the mixing pipe film hole orifices, known per se, are provided, via which supply air is fed in along the inner wall of the mixing pipe in order to form a near-wall air film.

In order to prevent the hydrogen-containing synthesis gas reaching regions near the burner wall, according to the diagrammatic longitudinal sectional illustration in FIG. 2*b* the synthesis gas $B_{H2}$ is discharged into the swirl space of the swirl generator 1 at about 60° to the burner longitudinal axis A. In particular, hydrogen-rich fuels with hydrogen fractions of >50% typically have very high flame velocities and, furthermore, have a very much lower volume-specific calorific value ($MJ/m^3$) and therefore very much larger quantities of hydrogen-containing fuel are required which have to be supplied to the burner in order to achieve a desired power-related combustion heat. Thus, in particular, it is shown in what are known as high-pressure tests that, even in the swirl space or along the mixing zone of the burner, ignition phenomena arise which are attributable to an insufficient intermixing of the hydrogen-containing fuel fed with a large volume flow into the burner. Even in cases where no flashback phenomena occur, an insufficient mixing of the hydrogen-containing synthesis gas and the combustion air ensures a diffusion-like combustion which ultimately leads to increased nitrogen oxide emissions. There is therefore the desire to conform to the requirements for the avoidance of flashback phenomena and to the $NO_x$ emission limits demanded in light of increasingly more stringent environmental requirements.

The disadvantages which the premix burner concept known hitherto entails are summarized below in inconclusive form, 1. There are inadequate precautions for the avoidance of flame flashback events which are attributable, inter alia, to insufficient flow coordination between the hydrogen-containing fuel stream to be fed into the burner space and the fuel/air swirl flow forming within the swirl generator.

2. Increased $NO_x$ emissions which occur as a result of an additional fuel enrichment of synthesis gas along the burner axis and of an accompanying temperature rise.

3. A complicated form of construction of the burner arrangement on account of a multiplicity of fuel lines which lead into the swirl space and are fed in each case via separate fuel distributor circuits which, overall, also cause an insufficient flow coordination referred to above.

4. The power variation of the burner due to the variation in the fuel supply is very limited, especially since fuel instabilities are formed which are distinguished, inter alia, by the occurrence of combustion chamber pulsations.

SUMMARY

The present disclosure is directed to a method for operating a burner. The method includes providing a burner having a swirl generator which forms a swirl flow of a combustion air stream. The swirl generator is upstream of a mixing zone in which, within a first transitional portion, a flow guide acts. The flow guide runs in the flow direction and transfers the swirl flow formed in the swirl generator into a mixing pipe acting downstream of the flow guide. The burner also includes a device for injecting a liquid and/or gaseous fuel into the combustion air stream being present in the swirl generator. A fuel/air mixture thus obtained is ignited and burnt in a combustion chamber following the mixing zone downstream, at the same time forms a backflow zone. The method also includes introducing a fuel containing hydrogen or consisting of hydrogen within the flow guide and/or downstream of the flow guide into the upstream flow of the fuel/air mixture.

The present disclosure is also directed to a burner for the combustion of an admixture of gaseous and/or liquid fuel. The burner includes a swirl generator for forming a combustion air stream, the swirl generator is arranged upstream from a mixing zone in which, within a first transitional portion, a flow guide is present which runs in the flow direction and which serves for transferring the swirl flow formed in the swirl generator into a mixing pipe acting downstream of the flow guide. The burner also includes a device for injecting a liquid and/or gaseous fuel into the combustion air stream which is provided in the swirl generator. The fuel/air mixture thus obtained is ignited and burnt in a combustion chamber following the mixing zone downstream, at the same time forming a backflow zone. The burner also includes an infeed for the infeed of a fuel containing hydrogen or consisting of hydrogen and is provided within the flow guide and/or downstream of the flow guide.

BRIEF DESCRIPTION OF THE DRAWINGS

The invention is described by way of example below, without the general idea of the invention being restricted, by exemplary embodiments, with reference to the drawings in which.

DETAILED DESCRIPTION OF THE PREFERRED EMBODIMENTS

Introduction to the Embodiments

Figure 1:
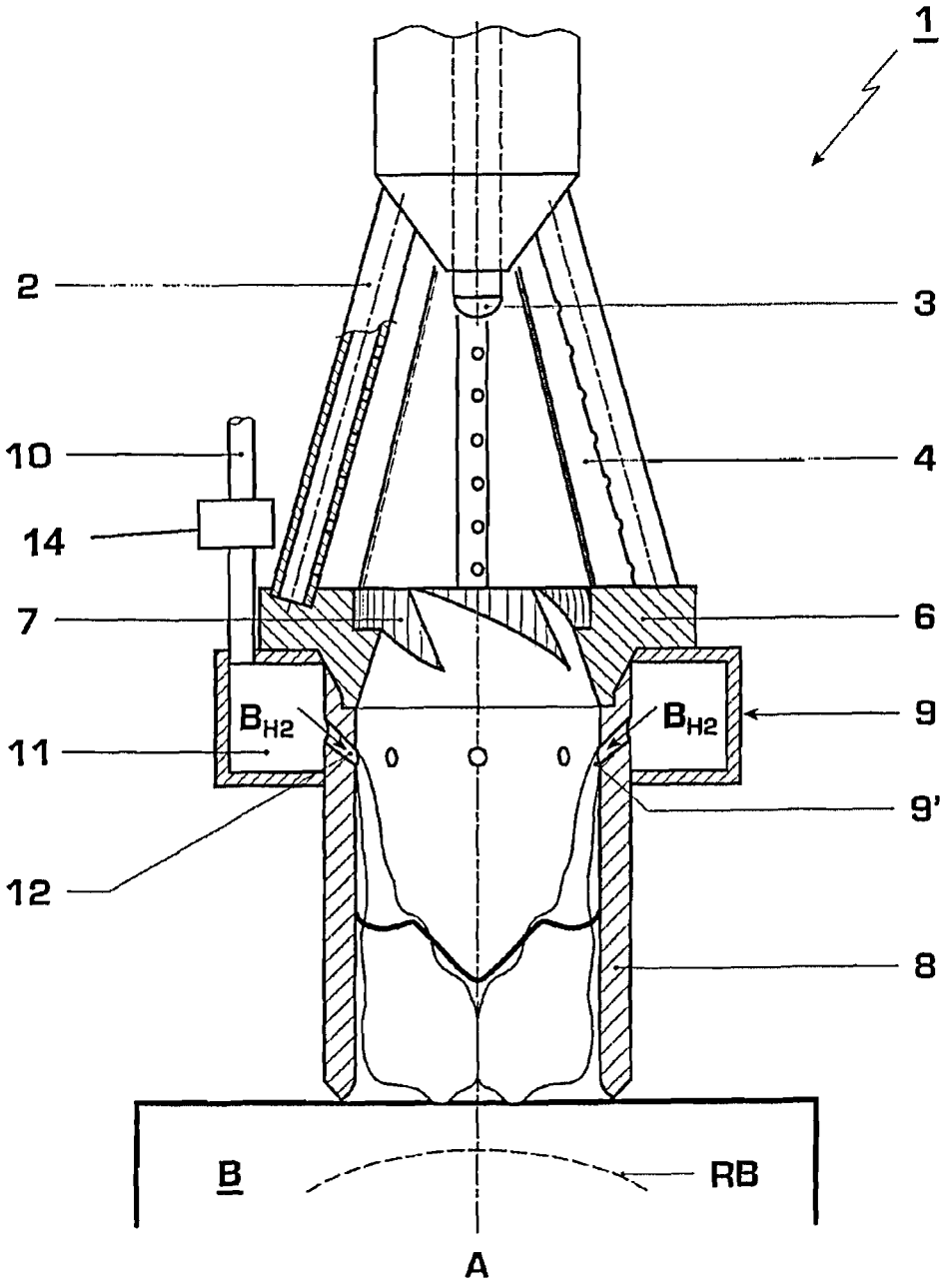
FIG. 1 shows a longitudinal sectional illustration through a premix burner designed according to the solution.
Figure 2A:
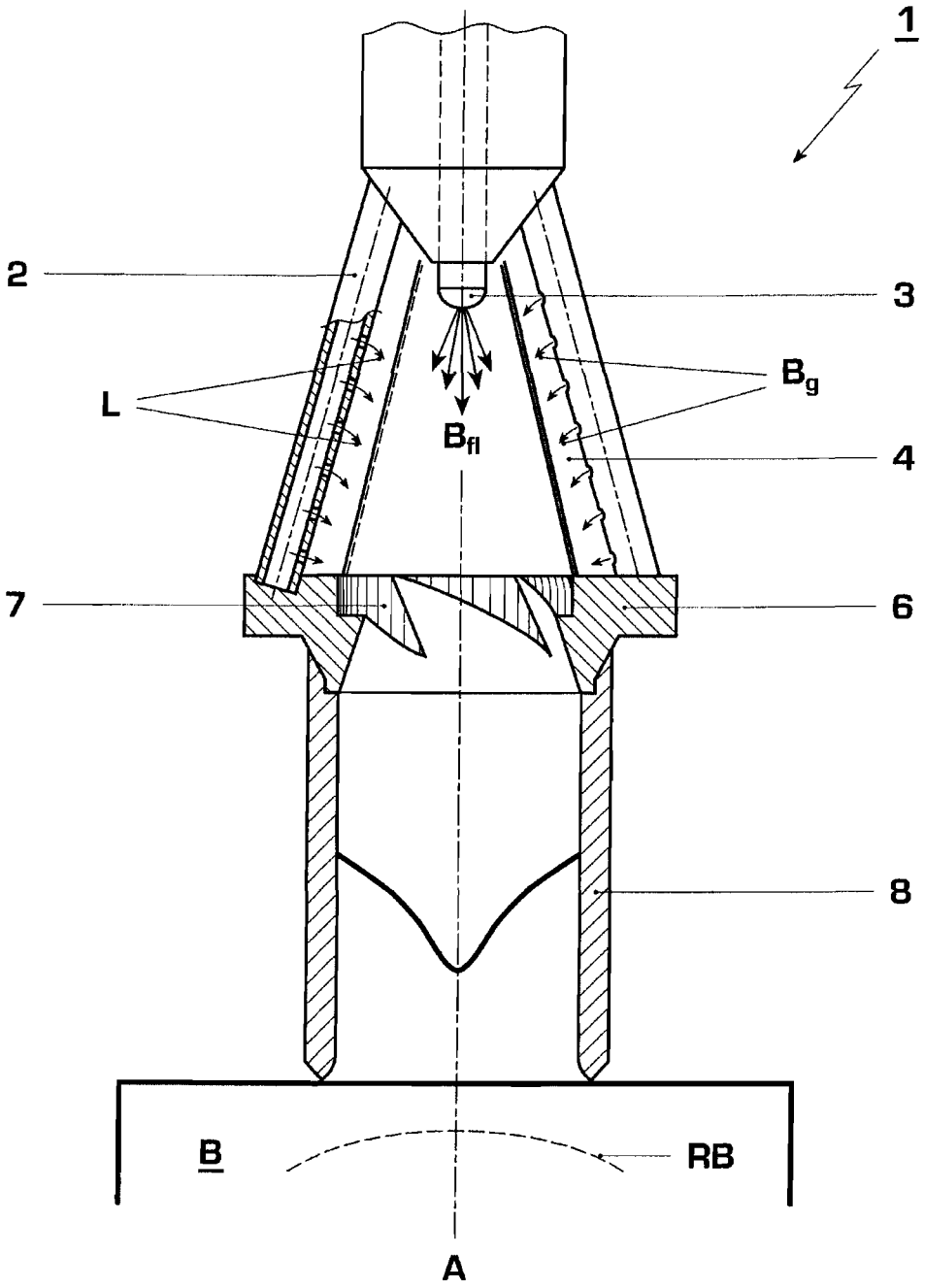
Fig. 2a (Prior Art)
FIGS. 2*a*, 2*b* show longitudinal sectional illustrations through a premix burner according to the prior art.
Figure 2B:
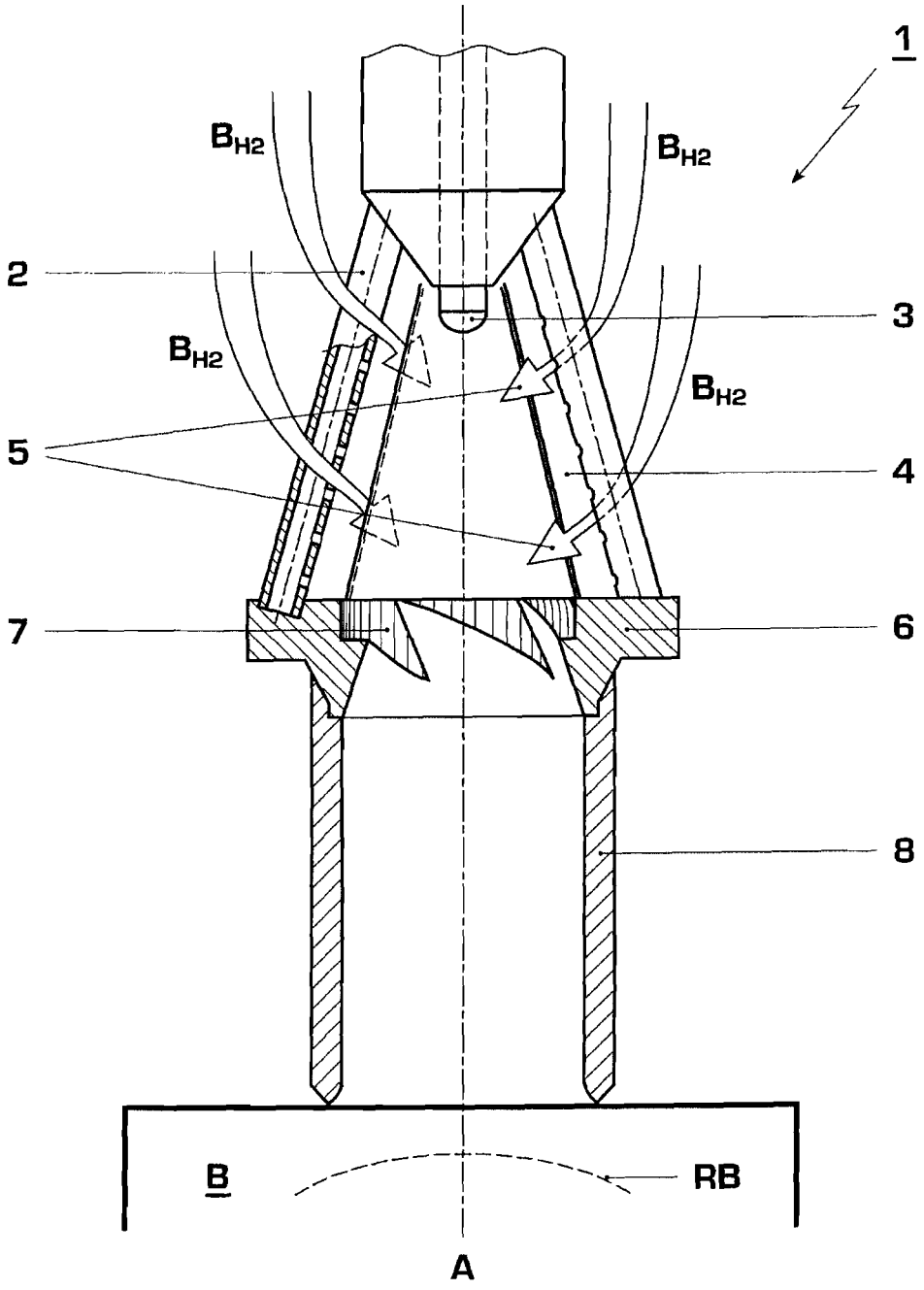
Fig. 2b (Prior Art)
Figure 3A:
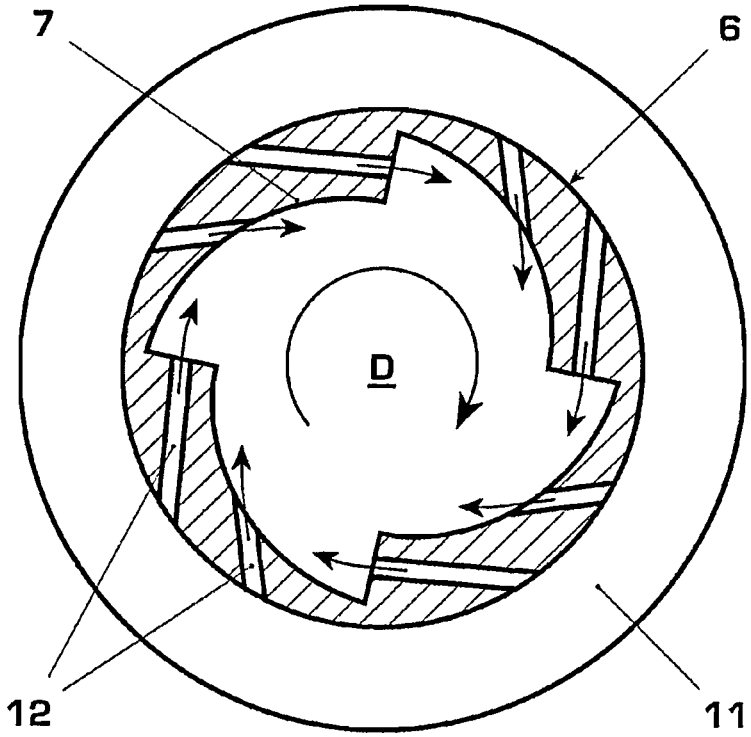
FIG. 3*a* shows a cross-sectional illustration through the transitional portion of a burner designed according to the solution.
Figure 3B:
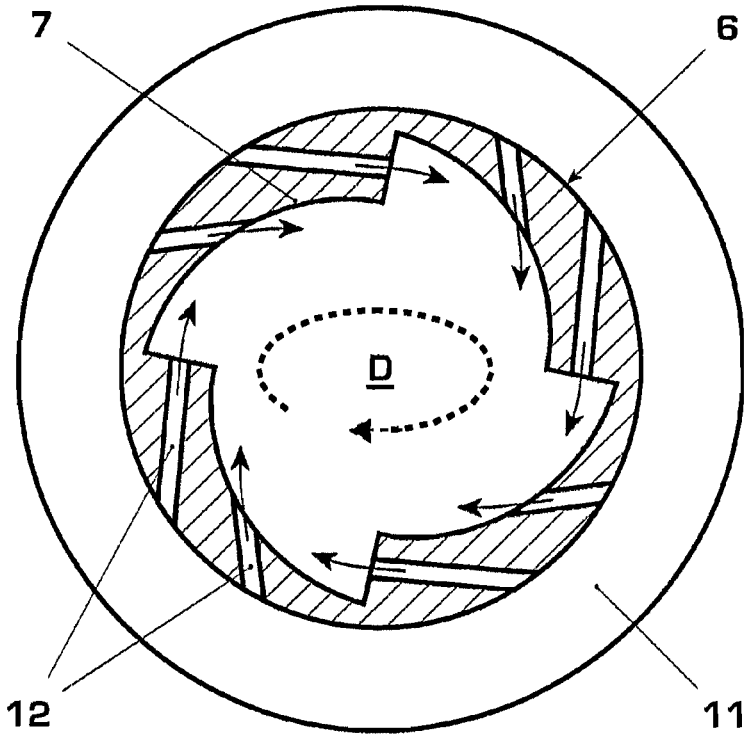
FIG. 3*b* shows a cross-sectional illustration through the transitional portion of a burner showing an elliptical flow cross section.
Figure 3C:
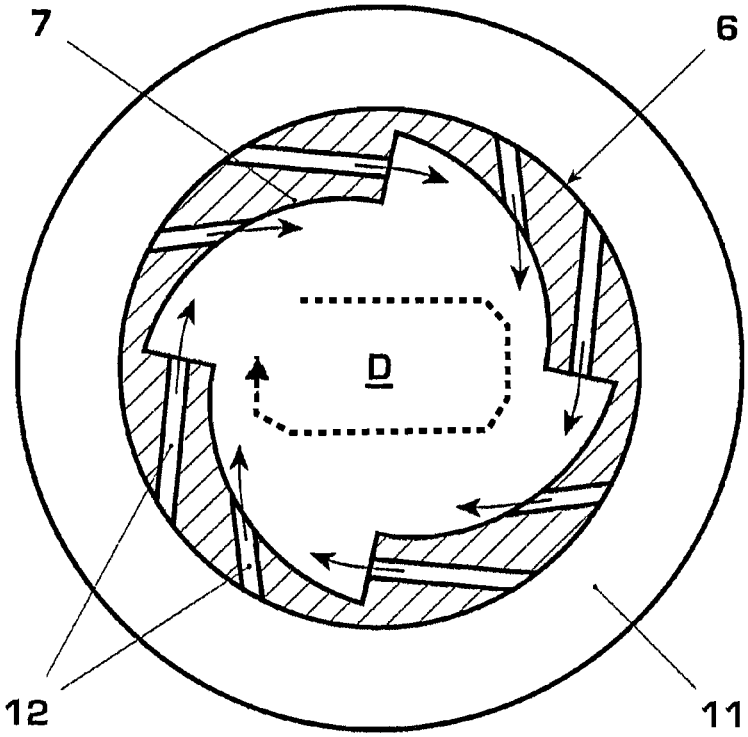
FIG. 3*c* shows a cross-sectional illustration through the transitional portion of a burner showing a virtually rectangular flow cross section.
Figure 3D:
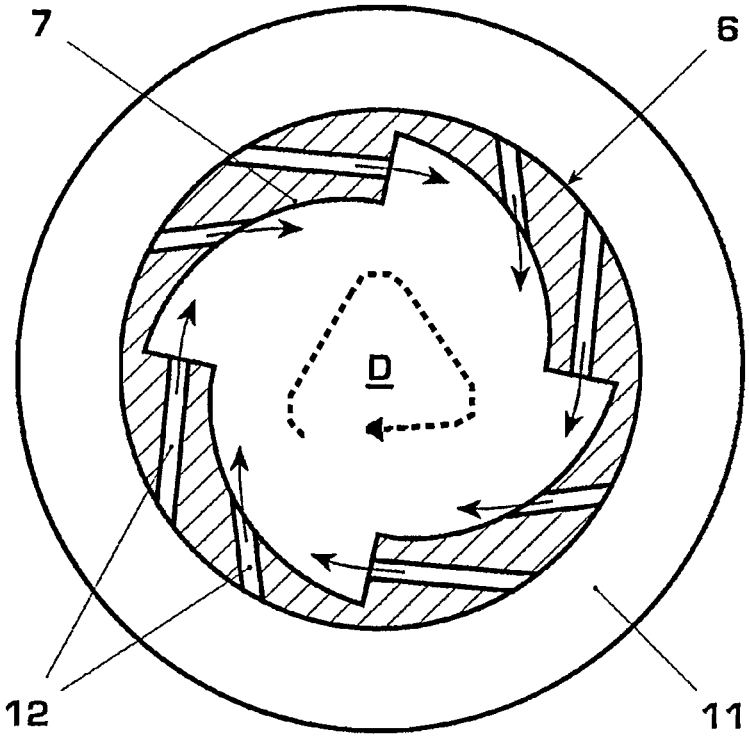
FIG. 3*d* shows a cross-sectional illustration through the transitional portion of a burner showing a virtually triangular flow cross section.

Proceeding from the aforementioned prior art, the object of the present invention is to provide a method for operating a premix burner and a premix burner itself, in which the above disadvantages are to be avoided. Furthermore, in the case of operation with a hydrogen-containing fuel, what is known as a synthesis gas, it is appropriate to ensure an improved intermixing with the burner air swirl flow and more stable flow conditions within the burner.

This is accomplished by the method and apparatus according to the invention. Features of the invention are the subject matter of the claims and may be gathered from the further description with reference to the exemplary embodiments.

The solution of the invention for operating a premix burner is based on both the properties of the hydrogen-containing fuel and the characteristics of the above-designated premix burner in order to achieve the declared aim, to be precise the achievement of as low emission values as possible, without the occurrence of flame flashback events, this being obtained in the case of only minor or, where appropriate, negligible burner instabilities.

Thus, the low volume-specific calorific value and the higher volume flow thereby required and also the low density of the hydrogen-containing synthesis gas are advantageously utilized in that, on the one hand, the high synthesis gas volume flow is employed for the directed raising of the flow velocity in the flow regions near the burner wall, in order to reduce the flame flashback risk downstream of the transitional portion. On the other hand, the only low fuel density of the synthesis gas contributes to an improved intermixing with the swirl flow of the combustion air, in that centrifugal forces within the swirl flow are utilized in order to allow a radial intermixing of the synthesis gas with the combustion air. When synthesis gas is supplied in radially outer regions of the swirl flow, a displacement of the lighter synthesis gas into near-axis regions with respect to the burner axis takes place on account of the heavier air fractions which are driven radially outward by the centrifugal forces acting within the swirl flow.

On the basis of the above considerations, a method according to the solution for the combustion of gaseous fuel containing hydrogen or consisting of hydrogen, synthesis gas in brief, with a burner, according to the preamble of claim 1, is distinguished in that the synthesis gas is fed into the fuel/air swirl flow within the region of the transitional portion.

The transitional portion between the region of the swirl generator and the mixing pipe following downstream serves primarily for a largely loss-free transfer of the swirl flow, widening conically within the swirl generator in the burner longitudinal axis, into a cylindrical swirl flow propagating along the mixing pipe having a constant flow cross section. The transfer of the flow form into a cylindrical swirl flow takes place by flow guide plates or flow guide contours provided along the transitional portion. In spite of all the measures for as loss-free a flow transfer as possible, in particular, the transitional portion contributes decisively to ensuring that the flow velocity in the near-wall regions along the mixing pipe is much lower than the flow velocity in the region of the burner axis or mixing pipe axis. According to the solution, therefore, it is proposed, at the location which causes a reduction in flow velocity along the burner wall or mixing pipe wall, to take measures in order to increase the flow velocity in this region. As stated above, because of the high volume flow rate specific to it, synthesis gas is particularly suitable for accelerating the flow behavior of near-wall flow regions in a directed manner. According to the solution, the directed infeed of the hydrogen-containing synthesis gas along the transitional portion takes place in such a way that the additional fuel infeed is admixed in the direction of the swirl flow which in any case passes the transitional portion, that is to say the synthesis gas is fed in, in relation to the burner longitudinal axis, with a tangential and a radial flow component suitably selected with respect to the swirl flow forming inside the burner. In this case, it is appropriate to carry out the fuel infeed in such a way that a flow irritation of the fuel/air swirl flow already formed within the burner is minimal. Thus, the fuel injection is adapted to local flow angles, in order to avoid the risk of flame flashback due to increased turbulence. Moreover, for purposes of improved intermixing, it is advantageous to carry out the synthesis gas infeed along the transitional portion with a radial component, that is to say with an angular component transverse to the prevailing flow direction of the swirl flow, so that the synthesis gas fed in is intermixed as effectively as possible with the fuel/air swirl flow. On the other hand, however, too pronounced a radial component, that is to say too large an angle selected between the burner axis and synthesis gas infeed direction, would be too detrimental to the flow-dynamic propagation behavior of the swirl flow, with the result that local, preferably near-wall flow vortices are formed and the flame flashback risk is increased. It is shown that the synthesis gas infeed has to be carried out with a compromise between an effective acceleration of near-wall flow regions for the purpose of reducing the flame flashback risk and as good an intermixing as possible with the swirl flow.

For another reason, too, the transitional portion is suitable for the injection of an additional synthesis gas flow, especially since the transitional portion is delimited by a transitional piece which is designed with a sufficiently large wall thickness and by which a multiplicity of individual outlet orifices can be provided for the synthesis gas supply. The design of the outlet orifices and the individual synthesis gas supply ducts connected to the outlet orifices can be carried out, virtually as desired, in terms of form and position, without any structural restrictions, especially since the transitional piece provides sufficient space for these measures.

It is also possible to use for the infeed of synthesis gas what are known as film holes which are already arranged, distributed along the transitional portion, and through which usually air is fed in which lies snugly as an air film along the burner wall or mixing pipe wall. It is thereby possible to avoid a permanent infeed of scavenging air, even when the burner is operated with natural gas or crude oil.

Moreover, depending on the structural design of the outlet orifices which are present within the transitional portion and through which synthesis gas is discharged, it is possible to form synthesis gas flows with a circular, elliptic, annular, virtually rectangular or virtually triangular flow cross section which contributes to an improved intermixing with the fuel/air swirl flow present within the burner.

Regarding the apparatus designed according to the solution for the combustion of gaseous fuel containing hydrogen or consisting of hydrogen, with a burner described in the claims, reference is made particularly to the statements made below in order to explain the exemplary embodiments. A burner designed in this way according to the solution has, along the transitional portion, a device for the infeed of the synthesis gas containing at least the hydrogen.

DETAILED DESCRIPTION

FIG. 1 shows a longitudinal sectional illustration of a premix burner designed according to the solution, with a swirl generator 1, the swirl space of which is surrounded by two swirl shells in the form of part conical shells 2 which in each case delimit reciprocally air inlet slots 4 through which combustion supply air is fed in, at the same time forming a swirl flow within the swirl space. The swirl flow surrounds a liquid fuel column which propagates conically and which is discharged by liquid fuel discharge through the centrally mounted fuel nozzle 3. In addition, as is not illustrated in any more detail in the drawing, further infeeds for gaseous fuel, preferably natural gas, which is admixed to the air, are provided along the air inlet slots 4. The air/fuel swirl flow which thus forms within the swirl generator 1 undergoes downstream of the swirl generator 1, by the transitional portion 6, a transfer of the originally conically propagating swirl flow into a swirl flow propagating cylindrically, that is to say with a constant flow cross section, longitudinally with respect to the burner axis A. The burner concept according to the solution provides for additionally introducing hydrogen-containing fuel, that is to say synthesis gas, along the transitional portion through a further fuel infeed 9.

The additional fuel infeed in the region of the transitional portion 6 takes place via individual outlet orifices which are circularly arranged, uniformly distributed, and which are all supplied with synthesis gas $B_{H2}$ via a common supply line 10. The fuel line 10 issues into a fuel reservoir 11 which surrounds the transitional portion 6 circularly and from which the individual outlet orifices 9' of the fuel infeed 9 are supplied with fuel.

The fuel containing hydrogen or consisting of hydrogen is fed into the region of the transitional portion 6 with a flow impulse which is adapted to or corresponds to the flow impulse of the rotating fuel/air swirl flow D propagating along the transitional portion 6.

The infeed of the synthesis gas $B_{H2}$ in this case takes place in such a way that the near-wall regions, in particular of the mixing pipe 8 following the transitional portion 6 downstream, are accelerated in terms of their flow behavior, in order to reduce the risk of flame flashback. It is likewise appropriate, however, to carry out the fuel infeed with only minor impairments of the swirl flow forming within the swirl generator 1.

The radial component with which the fuel infeed is introduced into the region of the transitional portion 6 and of the mixing pipe 8 following the latter downstream can likewise be seen from the longitudinal sectional illustration illustrated in FIG. 1. The direction, slightly inclined with respect to the burner axis A, of the fuel infeed of the synthesis gas $B_{H2}$ contributes to the improved intermixing of the fuel with the fuel/air swirl flow, and yet, because of the centrifugal force caused by the rotational movement within the swirl flow, a radial exchange of the lighter hydrogen-containing fuel with the heavier air fractions of the swirl flow is assisted. It can be seen from the longitudinal sectional illustration in FIG. 1 that, immediately before it enters the combustion chamber B adjacent to the mixing pipe 8 downstream, the hydrogen-containing fuel $B_{H2}$ is intermixed so as to be distributed as homogeneously as possible over the entire flow cross section.

As described above, in addition to the synthesis gas infeed carried out with a radial component, the synthesis gas is additionally also fed in with a component tangential to the swirl flow, in order to irritate the swirl flow as little as possible. To make clearer the tangential infeed of the hydrogen-containing synthesis gas in the peripheral circumferential direction of the fuel/air swirl flow forming within the burner, reference may be made to FIG. 3 which shows a cross-sectional illustration in the region of the transitional portion 6. The inner contour of the transitional portion 6 is defined by flow guide 7 which widens conically in the throughflow direction and which are optimized in flow terms and can transfer the conically widening swirl flow into a swirl flow propagating with a constant flow cross section. Surrounding the flow guide 7 radially, the reservoir 11 storing the synthesis gas is provided, which is supplied with fuel via the supply line 10 illustrated in FIG. 1. Within the transitional portion 6, for the infeed of the hydrogen-containing fuel, a plurality of supply ducts 12 are provided, via which the synthesis gas is fed into the inner space of the transitional portion 6. The spatial orientation of the individual fuel supply ducts 12 is carried out in such a way that the fuel discharge lies snugly, largely tangentially, against the swirl flow D forming within the burner, without the flow behavior of the swirl flow in this case being appreciably impaired. It may be emphasized once again at this juncture that, although a fuel infeed with an increasingly radial component ensures an improved intermixing with the swirl flow forming within the burner, it also increasingly irritates the flow behavior of said swirl flow, with the result that the undesirable turbulent vortex formations occur which, in turn, increase the risk of flame flashback. To that extent, the arrangement and design of the flow ducts through with the synthesis gas is fed into the interior of the burner must be carried out with a compromise between an optimized mixture quality and a reduced flame flashback risk.

Figure 4:
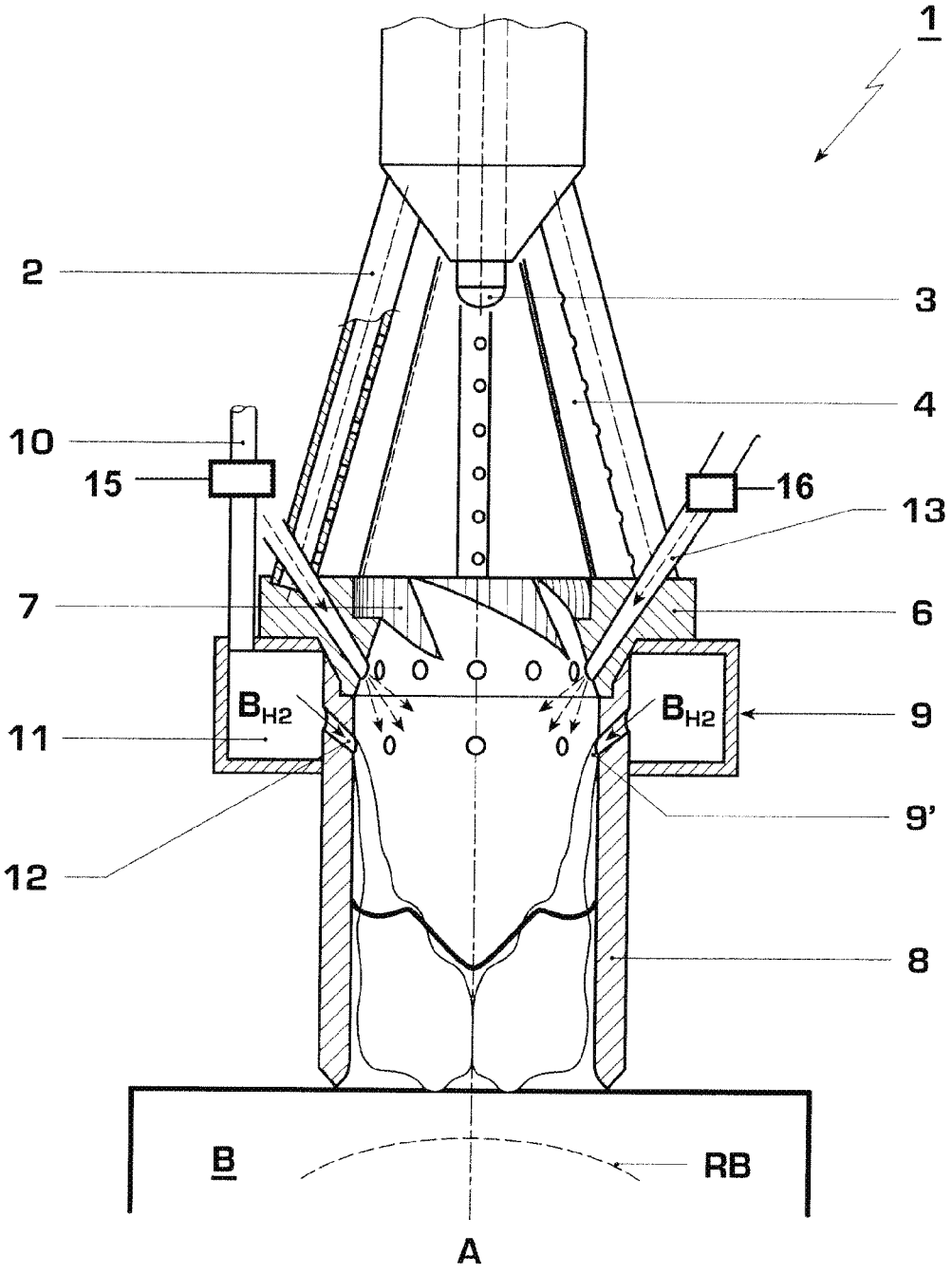
FIG. 4 shows a longitudinal section of a further exemplary embodiment through a burner designed according to the solution.

In a further longitudinal sectional illustration according to FIG. 4, upstream of the outlet orifices 9' of the supply ducts 12, scavenging gas ducts 13 are provided, through which additional air is discharged in a way known per se along the wall of the mixing pipe 8 following the transitional portion 6 downstream. In the exemplary embodiment illustrated in FIG. 4, hydrogen-containing synthesis gas is also discharged through the scavenging gas ducts 13, particularly in cases where the burner is operated with natural gas and crude oil. The additional utilization of already existing scavenging gas ducts or film hole orifices with hydrogen-containing fuel contributes to controlling or influencing the fuel concentration in the region of the burner wall, that is to say of the wall along the mixing pipe.

The burner concept according to the solution thus helps to reduce the flame flashback risk considerably, on the one hand by a near-wall flow velocity increase along the mixing pipe and, on the other hand, by an individual adaptation of the infeed of additional fuel, that is to say of hydrogen-containing fuel, to the swirl flow already being formed within the swirl generator, with the result that turbulent vortex formations can be largely avoided or reduced. On account of the much lower specific gravity of the hydrogen-containing synthesis gas fed in, as compared with the much larger air fraction of the swirl flow forming within the burner, the centrifugal force occurring due to the rotational movement causes a radial intermixing of the synthesis gas fed in the peripheral margin region, in such a way that a complete intermixing of the hydrogen fed in is achieved before the air/fuel swirl flow enters the combustion chamber. Moreover, because of the space available within the transitional portion, it is possible to carry out the measure for fuel infeed in robust form of construction and with high integrity. Thus, the fuel supply lines and the outlet orifices can be individually configured and dimensioned as a function of the selected hydrogen-containing fuel. Already existing scavenging air supply orifices for the formation of near-wall film layers can likewise be utilized for the infeed of hydrogen-containing synthesis gas. Owing to the additional infeed of synthesis gas only in the region of the transitional portion 6, the average dwell time of the hydrogen is much lower, as compared with an infeed along the swirl generator, so that burner operation can be carried out correspondingly more reliably.

LIST OF REFERENCE SYMBOLS

1 Swirl generator
2 Swirl shells, part conical shells
3 Fuel nozzle
4 Air inlet slots
5 Infeed for synthesis gas
6 Transitional portion
7 Flow guide
8 Mixing pipe
9 Infeed for a hydrogen-containing fuel
9' Outlet orifice
10 Supply line
11 Fuel reservoir
12 Supply lines
13 Lines for cleaning air or scavenging gas
14 Catalytic oxidizer
15 Intermittent cleaning air source
16 Flow pulse fuel source
A Burner axis
B Combustion chamber
D Swirl flow
RB Backflow bubble, backflow zone
$B_{H2}$ Synthesis gas
$B_{fl}$ Liquid fuel
$B_g$ Gaseous fuel
L Combustion air

What is claimed is:

1. A method for operating a burner, comprising:

providing a burner comprising a swirl generator which forms a swirl flow of a combustion air stream, the swirl generator being upstream of a mixing zone in which, within a first transitional portion, a flow guide is arranged and extends in a flow direction and transfers the swirl flow formed in the swirl generator into a mixing pipe downstream of the flow guide, a device for injecting a liquid and/or gaseous fuel into the combustion air stream being present in the swirl generator, and a fuel/air mixture thus obtained being ignited and burnt in a combustion chamber downstream of the mixing zone, at the same time forming a recirculation flow in the form of a backflow bubble in the combustion chamber; and introducing a gaseous fuel containing hydrogen or consisting of hydrogen within the flow guide and/or downstream of the flow guide into a flow of the fuel/air mixture, with a tangential component oriented in a swirl direction of fuel/air swirl flow and with a radial component oriented longitudinally with respect to an axis of the burner, in such a way that a flow irritation disturbance of the fuel/air swirl flow is minimized, wherein the fuel containing hydrogen or consisting of hydrogen is fed into the first transitional portion with a flow impulse which corresponds to the flow impulse of the fuel/air swirl flow propagating along the first transitional portion, and wherein the fuel is injected corresponding to local flow angles within the flow guide.

2. The method as claimed in claim 1, wherein the gaseous fuel containing hydrogen or consisting of hydrogen is fed in the form of a multiplicity of individual fuel flows in a circular distribution around the rotating fuel/air swirl flow.

3. The method as claimed in claim 2, wherein directly upstream of the infeed of the gaseous fuel containing hydrogen or consisting of hydrogen, cleaning air is discharged at least intermittently via fuel outlet orifices.

4. The method as claimed in claim 1, wherein said gas flow has a circular, elliptic, annular, virtually rectangular or virtually triangular flow cross section.

5. The method as claimed in claim 1, wherein the gaseous fuel containing hydrogen or consisting of hydrogen is partially oxidized catalytically before entering into the swirl generator.

6. The method as claimed in claim 1, comprising:

utilizing centrifugal forces within the swirl flow in order to allow a radial intermixing of the synthesis gas with the combustion air.

7. The method as claimed in claim 1, wherein the fuel is injected corresponding to the local flow angles within the flow guide while being injected into the flow of the fuel/air mixture along the first transitional portion with the radial component transverse to the flow direction of the swirl flow to intermix the gaseous fuel with the fuel/air swirl flow.

8. The method as claimed in claim 1, wherein the fuel is injected via a supply line through a wall section which extends in a radial direction towards a central area of the first transitional portion.

9. A burner for the combustion of an admixture of gaseous and/or liquid fuel, the burner comprising a swirl generator for forming a combustion air stream, the swirl generator arranged upstream from a mixing zone in which, within a first transitional portion, a flow guide is present which runs in the flow direction and which serves for transferring the swirl flow formed in the swirl generator into a mixing pipe acting downstream of the flow guide;

a device for injecting a liquid and/or gaseous fuel into the combustion air stream is provided in the swirl generator, and the fuel/air mixture thus obtained being ignited and burnt in a combustion chamber located of the mixing zone, at the same time forming a recirculation flow in the form of a backflow bubble in the combustion chamber; and an infeed for the infeed of a gaseous fuel containing hydrogen or consisting of hydrogen is provided within the flow guide and/or downstream of the flow guide, the infeed comprising a plurality of individual outlet orifices, configured and arranged in such a way that the fuel can be discharged with a tangential and a radial component in relation to an axis of the burner, wherein the fuel containing hydrogen or consisting of hydrogen is fed into the first transitional portion with a flow impulse which corresponds to the flow impulse of the fuel/air swirl flow propagating along the first transitional portion, and wherein the device is configured to inject the fuel corresponding to local flow angles within the flow guide.

10. The burner as claimed in claim 9, wherein the individual outlet orifices which are circularly formed, equally distributed, in the first transitional portion and out of which the gaseous fuel containing hydrogen or consisting of hydrogen can be discharged.

11. The burner as claimed in claim 9, wherein the swirl generator comprises at least two hollow part conical shells nested one in the other in the flow direction and completing one another to form a body, in that the cross section of the inner space formed by the hollow part conical shells increases in the flow direction, and the respective longitudinal axes of symmetry of these part conical shells run, offset to one another, in such a way that the adjacent walls of the part conical shells form in their longitudinal extent tangential slots or ducts for the flow of a combustion air into the inner space formed by the part conical shells.

12. The burner as claimed in claim 9, wherein the swirl generator comprises at least two hollow part shells nested one in the other in the flow direction and completing one another to form a body, in that the cross section of the inner space formed by the hollow part shells runs cylindrically or quasi-cylindrically in the flow direction, the respective longitudinal axes of symmetry of these part shells run, offset to one another, in such a way that the adjacent walls of the part shells form in their longitudinal extent tangential slots or ducts for the flow of a combustion air into the inner space formed by the part shells, and in that the inner space has an inner body, the cross section of which decreases in the flow direction.

13. The burner as claimed in claim 12, wherein the inner body runs conically or quasi-conically in the flow direction.

14. The burner as claimed in claim 9, wherein the device for injecting a liquid and/or gaseous fuel into the combustion air stream is configured to utilize centrifugal forces within the swirl flow in order to allow a radial intermixing of the synthesis gas with the combustion air.

15. The burner as claimed in claim 9, wherein the device is configured to inject the fuel corresponding to the local flow angles within the flow guide while being injected into the flow of the fuel/air mixture along the first transitional portion with the radial component transverse to the flow direction of the swirl flow to intermix the gaseous fuel with the fuel/air swirl flow.

16. The burner as claimed in claim 9, wherein the device is configured to inject the fuel via a supply line through a wall section which extends in a radial direction towards a central area of the first transitional portion.

* * * * *